US006721983B2

(12) United States Patent
Dallas et al.

(10) Patent No.: US 6,721,983 B2
(45) Date of Patent: Apr. 20, 2004

(54) MULTI-FUNCTION TOOL WITH LEVER LATCH

(75) Inventors: Edgar A. Dallas, Beaverton, OR (US); Phillip A. Montague, Tualatin, OR (US)

(73) Assignee: Fiskars Brands, Inc., Madison, WI (US)

( * ) Notice: Subject to any disclaimer, the term of this patent is extended or adjusted under 35 U.S.C. 154(b) by 0 days.

(21) Appl. No.: 09/861,862

(22) Filed: May 21, 2001

(65) Prior Publication Data

US 2002/0046425 A1 Apr. 25, 2002

Related U.S. Application Data

(63) Continuation-in-part of application No. 09/803,415, filed on Mar. 9, 2001, now abandoned.

(51) Int. Cl.[7] ..... B25B 7/22

(52) U.S. Cl. ..... 7/128; 7/168; 81/423; 81/427.5

(58) Field of Search ..... 7/125, 127–131, 7/167–168; 81/415–416, 419–424, 427.5; 30/156, 192–193, 236, 260, 341–342; 403/326–330, 321–322, 325, 108–110, 94–95; 279/23.1, 24, 46.7, 79

(56) References Cited

U.S. PATENT DOCUMENTS

| | | | | |
|---|---|---|---|---|
| 208,878 A | | 10/1878 | Allen et al. | |
| 691,050 A | * | 1/1902 | Dronne | |
| 816,674 A | | 4/1906 | Medhus | |
| 1,079,997 A | | 12/1913 | Wernimont | |
| 1,334,425 A | | 3/1920 | Wernimont | |
| 1,514,488 A | | 11/1924 | Wernimont | |
| 2,651,227 A | | 9/1953 | Kennington | |
| 4,316,315 A | | 2/1982 | Vogelnik | |
| 4,354,313 A | | 10/1982 | Naifeh | |
| 4,954,008 A | * | 9/1990 | Dicke et al. | 403/330 |
| 5,245,721 A | | 9/1993 | Lowe et al. | |
| 5,280,659 A | | 1/1994 | Park | |
| 5,525,000 A | * | 6/1996 | Belobraydich et al. | 403/330 |
| 5,615,484 A | | 4/1997 | Pittman | |
| 5,664,274 A | * | 9/1997 | Collins | 81/423 |
| 5,692,304 A | | 12/1997 | Campbell | |
| 5,735,005 A | | 4/1998 | Wang | |

(List continued on next page.)

FOREIGN PATENT DOCUMENTS

| | | |
|---|---|---|
| DE | 29613051 U1 | 10/1996 |
| DE | 299 02 625 | 7/1999 |
| EP | 1 023 972 A2 | 8/2000 |
| WO | WO 00/21720 | 4/2000 |

*Primary Examiner*—D.S. Meislin
(74) *Attorney, Agent, or Firm*—Foley & Lardner LLP

(57) ABSTRACT

A multi-function tool includes two channel-shaped handles having a first side wall and a second side wall forming a channel therebetween. An interlocking mechanism includes a first plate extending from the first side wall, and a second plate extending from the second side wall. The handles can be releasably engageable by alignment of at least one post of one of the handles with at least one notch of the other handle. The multi-function tool also includes an interchangeable implement and a pair of handles with implement engaging means. An axle assembly can extend transversely through openings formed in the first and second plates and includes a first end member, a second end member, a pair of buttons and a spring. The interchangeable implement can be pivotally attached to the axle. Alternatively, the implement can be releasably coupled to the handles by a latch. The latch can include a rocker with a locking tab that is biased into locking engagement with the implement by a spring plate. The implement has a working portion and an opposed tang portion provided with handle engaging means.

20 Claims, 13 Drawing Sheets

U.S. PATENT DOCUMENTS

| | | | |
|---|---|---|---|
| 5,765,247 | A | 6/1998 | Seber et al. |
| 5,794,346 | A | 8/1998 | Seber et al. |
| 5,887,347 | A | 3/1999 | Gibbs |
| 5,979,059 | A | 11/1999 | Leatherman et al. |
| 6,023,805 | A | 2/2000 | Lin |
| D424,900 | S | 5/2000 | Budrow et al. |
| D427,501 | S | 7/2000 | Berg et al. |
| 6,088,860 | A | 7/2000 | Poehlmann et al. |
| 6,108,845 | A | 8/2000 | Hung et al. |
| 6,145,144 | A | 11/2000 | Poehlmann et al. |

* cited by examiner

FIG. 1
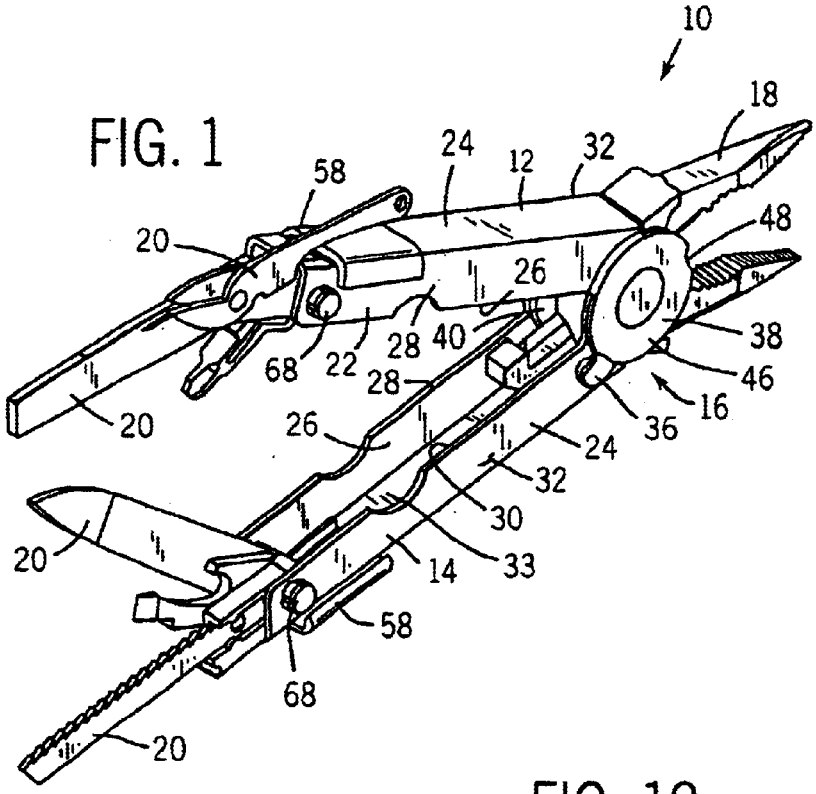
FIG. 12
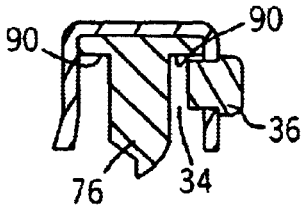
FIG. 10
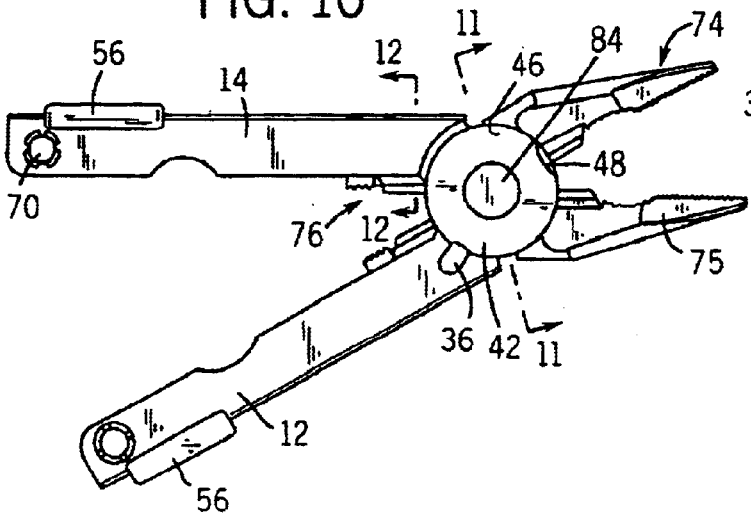
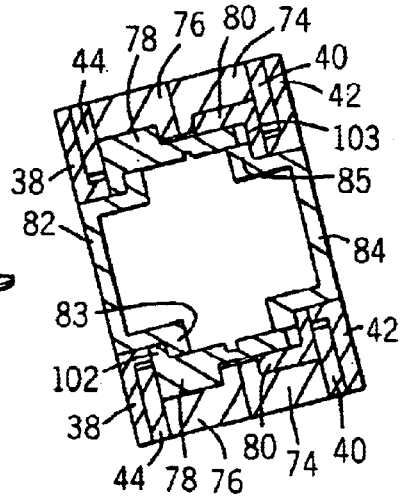
FIG. 11

MULTI-FUNCTION TOOL WITH LEVER LATCH

This is a continuation-in-part of application Ser. No. 09/803,415, filed Mar. 9, 2001, now abandoned.

FIELD OF THE INVENTION

This invention relates to a pocket tool with reversible pliers, and other pivotally attached ancillary tools. More particularly, the present invention relates to a multi-function tool which includes an easily removable implement such as a pair of pliers. The present invention further relates to a pocket tool provided with interchangeable handles.

BACKGROUND OF THE INVENTION

In general, multi-function tools, including in a single instrument, pliers, and other selected tools, such as screwdrivers, knife blades, files and the like, are well known. The prior art multi-function tools typically include a cross-jaw plier with channel-shaped handles connected to the shanks or tangs of the respective plier jaws. In one type of multi-function tool, the cross-jaw pliers are pivotally mounted to the handles at the distal end, the jaws being adapted to nest within the handle for storage. Examples of such multiple tools are described in U.S. Pat. Nos. 4,238,862, 4,744,272 and 4,888,869 issued on Dec. 16, 1980, May 17, 1988 and Dec. 26, 1989, respectively, to Timothy S. Leatherman.

In another type of multi-function tool, the tangs of the respective plier jaws are slidably affixed to the respective handles such that the jaws can be slidably retracted into the interior of the handle channels. Examples of such multi-function tools are described in U.S. Pat. Nos. 5,142,721 and 5,212,844 issued on Sep. 1, 1992 and May 25, 1993, respectively, to Sessions et al. These patents are incorporated herein by reference.

The plier jaws of the multi-function tools identified above are mechanically attached to the handles such that assembly of the plier jaws to the handles or removal of the plier jaws requires the use of a separate tool. The use of a separate tool inhibits the user from easily removing the plier jaws and the mechanical attachment of the jaws to the handles increases manufacturing costs.

It is therefore desirable to provide a multi-function tool in which the tool can be easily attached and removed from the handles without the use of a separate tool. Additionally, it is desirable to provide a handle engagement mechanism on the tool to positively lock the tool into engagement with the handles. Finally, it is also desirable to provide an interlocking mechanism to easily interchange handles, thereby allowing access to a larger variety of tools contained in different handle assemblies.

SUMMARY OF THE PRESENT INVENTION

An exemplary embodiment relates to a multi-function tool having a pair of handles. A latch mechanism is secured to at least one of the handles and includes a locking tab and a spring arm. An implement is removably secured to the pair of handles by the latch mechanism such that the locking tab engages a locking slot disposed in a tang of the implement.

Another embodiment relates to a latch mechanism for a multi-function tool. The latch mechanism includes a cap and a spring plate secured to a handle. A rocker having a locking tab is operatively coupled to the spring plate, such that the latch mechanism is configured to removably secure an implement to the handle.

Other principal features and advantages of the invention will become apparent to those skilled in the art upon review of the following drawings, the detailed description and the appended claims.

BRIEF DESCRIPTION OF THE DRAWINGS

The invention will hereafter be described with reference to the accompanying drawings, wherein like reference numerals denote like elements, and:

FIG. 1 is an isometric view of the pocket tool of the present invention in an open position with interchangeable handles;

FIG. 10 is a side view of the pocket tool of the present invention in an open position with interchangeable handles and removable implements;

FIG. 11 is a cross-sectional view taken generally along line 11—11 of FIG. 10;

FIG. 12 is a cross-sectional view taken generally along line 12—12 of FIG. 10;

DETAILED DESCRIPTION OF A PREFERRED EXEMPLARY EMBODIMENT

Figure 2:
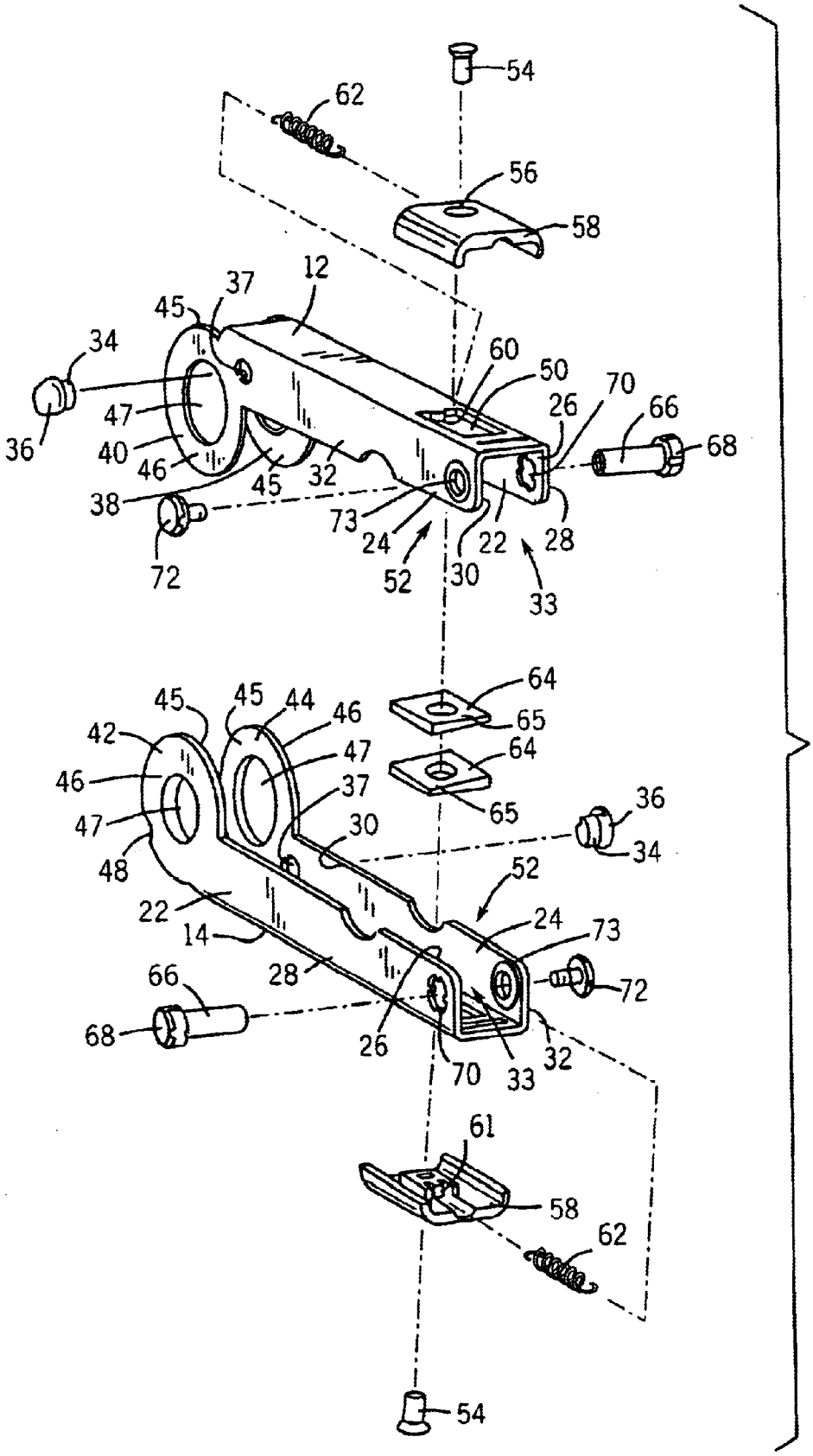
FIG. 2 is an exploded view of the interchangeable handles of the present invention.

Referring to FIG. 1, a detailed description of an exemplary multi-function tool 10 in accordance with the present invention will be described. Tool 10 includes a first channel-shaped handle 12, a second channel-shaped handle 14, an axle assembly 16, an interchangeable implement 18, and a plurality of pivotally attached ancillary tools 20.

First handle 12 includes a first side wall 22 and second handle 14 includes a second side wall 24, wherein first side wall 22 includes an inner surface 26 and an outer surface 28, and second side wall 24 includes an inner surface 30 and an outer surface 32. Inner surfaces 26 and 30 further define a channel 33 traversing the length of handles 12 and 14 and providing storage space for interchangeable implement 18 and ancillary tools 20. As will be explained in greater detail below, interchangeable implement 18 is removably and pivotally attached to axle assembly 16. Additionally, in the preferred embodiment of the present invention, handles 12 and 14 are each releasably engageable with axle assembly 16.

Referring to FIG. 2, the structure of handles 12 and 14 with regard to interchangeability will be described in greater detail. An inwardly extending post 34 coupled to an outwardly extending post 36 is received in an aperture 37 formed in second side walls 24 of handles 12 and 14. Inwardly extending post 34 extends perpendicular to inner surface 30 of second side wall 24 through channel 33 towards inner surface 26 of first side wall 22. Outwardly extending post 36 extends perpendicular to outer surface 32 of second side wall 24.

First handle 12 further includes a first plate 38 extending from first side wall 22 and a second plate 40 extending from second side wall 24. Similarly, second handle 14 further includes a first plate 42 extending from first side wall 22 and a second plate 44 extending from second wall 24. In the preferred embodiment, plates 38, 40, 42 and 44 are substantially circular with an inner surface 45 adjacent to inner surfaces 26 and 30, and an outer surface 46 adjacent to outer surfaces 28 and 32. An opening 47 formed through the center region of plates 38, 40, 42 and 44 is configured to receive axle assembly 16. A notch 48 is formed in the periphery of first plates 38 and 42, wherein each handle is releasably engageable by alignment of outwardly extending post 36 with notch 48.

Figure 3:
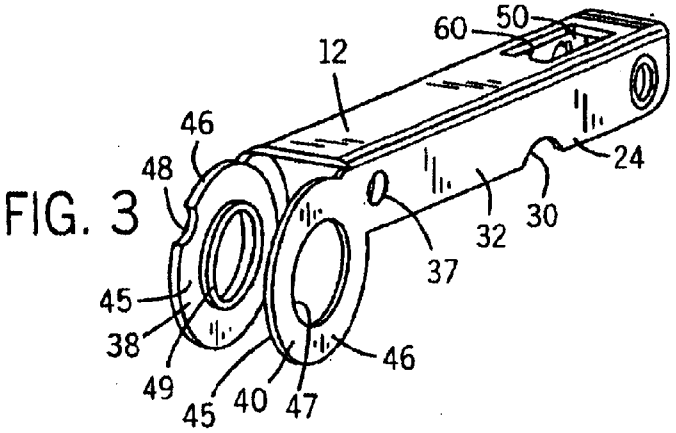
FIG. 3 is an isometric view of one of the interchangeable handles of FIG. 2.

Additionally, first plates 38 and 42 include a shoulder 49 (See FIG. 3) formed along the periphery of opening 47 and extending perpendicular to inner surface 45. In the preferred embodiment, outer surfaces 46 of first plates 38 and 42 are offset from outer surfaces 28 of first side walls 22 by a thickness equal to first side wall 22. On the other hand, outside surfaces 46 of second plates 40 and 44 are substantially flush with outer surfaces 32 of second side walls 24. This placement of plates 38, 40, 42 and 44 results in opening 47 of second plate 40 of first handle 12 rotationally engaging shoulder 49 formed on inner surface 45 of first plate 42 of second handle 14, while opening 47 of second plate 44 of second handle 14 engages shoulder 49 formed on inner surface 45 of first plate 38 of first handle 12.

First and second handles 12 and 14 also include a locking mechanism wherein a generally rectangular opening 50 extends through handles 12 and 14 located proximate a distal end 52 opposite plates 38, 40, 42 and 44. A rivet 54 extends through an aperture 56 in a locking button 58. A spring post 60 extends into rectangular opening 50 by a predetermined distance toward distal end 52. Locking button 58 includes a spring post 61 configured to receive one end of a compression spring 62. The other end of compression spring 62 is received by spring post 60. Rivet 54 secures locking button 58 to a wedge 64 having a beveled region 65. An axle bolt 66 having a keyed head 68 is received within a keyed aperture 70 located through first side wall 22 proximate distal end 52 of handles 12 and 14. Axle bolt 66 is secured by a screw 72 threaded through an aperture 73 formed in second side wall 24.

Figure 5:
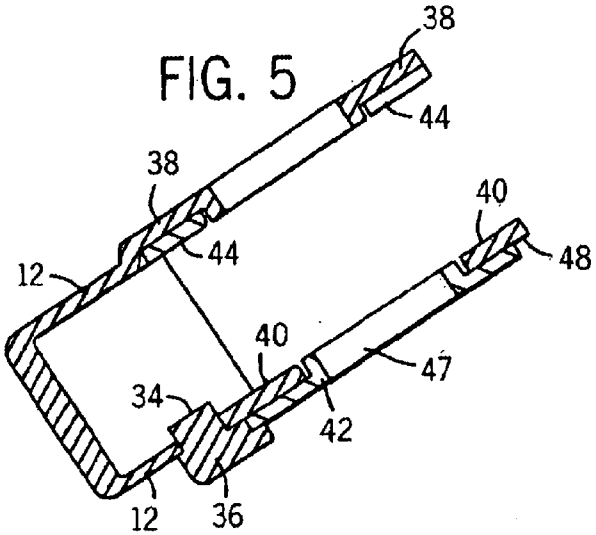
FIG. 5 is a cross-sectional view taken generally along line 5—5 of FIG. 4.
Figure 4:
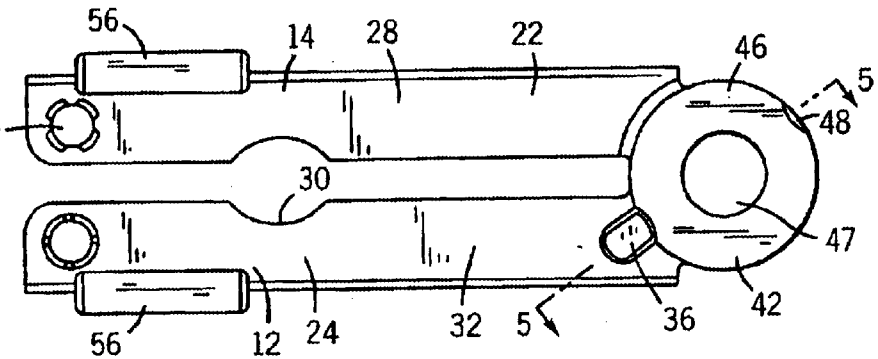
FIG. 4 is a partial side view of the interchangeable handles of the present invention in a closed position.

Releasable engagement of handles 12 and 14 is accomplished by the interlocking of plates 38, 40, 42 and 44 in addition to the engagement of post 36 with notch 48. In particular, as shown in FIGS. 3–6, post 36 overlaps outer surface 46 of plates 38 and 42 unless handles 12 and 14 are at a 180° angle to one another (FIG. 5). When handles 12 and 14 are at a 180° angle to one another (FIG. 6), post 36 is received in notch 48, resulting in outer surfaces 46 of plates 38 and 42 not being retained in mating engagement with one another. However, it is possible to set the relative angle to a position other than 180 degrees depending upon the specific location of the notch 48 and post 36. At any other angle other than 180°, post 36 overlaps outer surfaces 46 of plates 38 and 42, thereby retaining plates 38, 40, 42 and 44 in locked engagement. Handle 12 or 14 is removed by placing the handles in the position illustrated by FIG. 6 and pulling one of the handles away from the other handle after post 36 is received in notch 48. A new handle then is inserted by aligning the post or notch of the new handle with the respective post or notch of the old handle.

Figure 8:
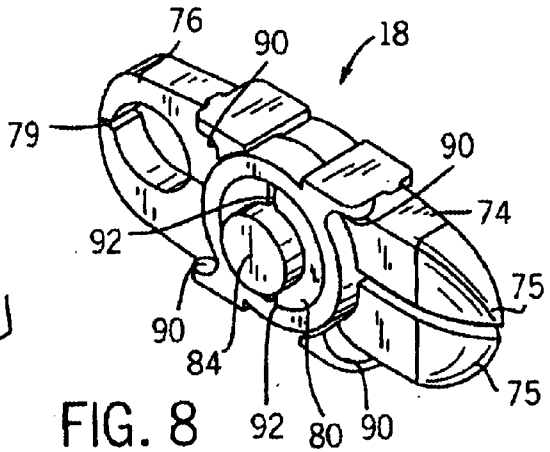
FIG. 8 is an isometric view of the two separate implements of FIG. 7.
Figure 7:
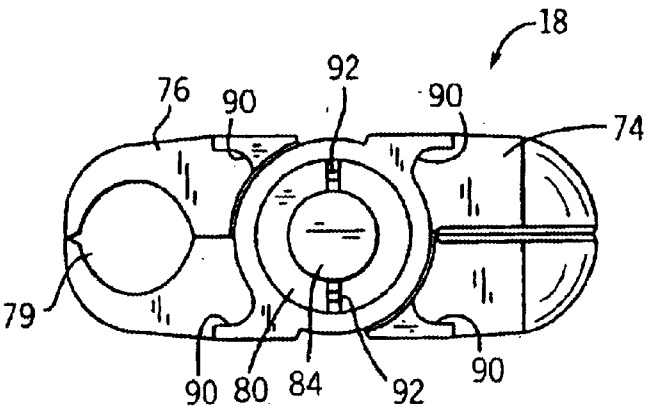
FIG. 7 is a side view of reversible implements of the present invention which are removable from the pocket tool of FIG. 1.
Figure 9:
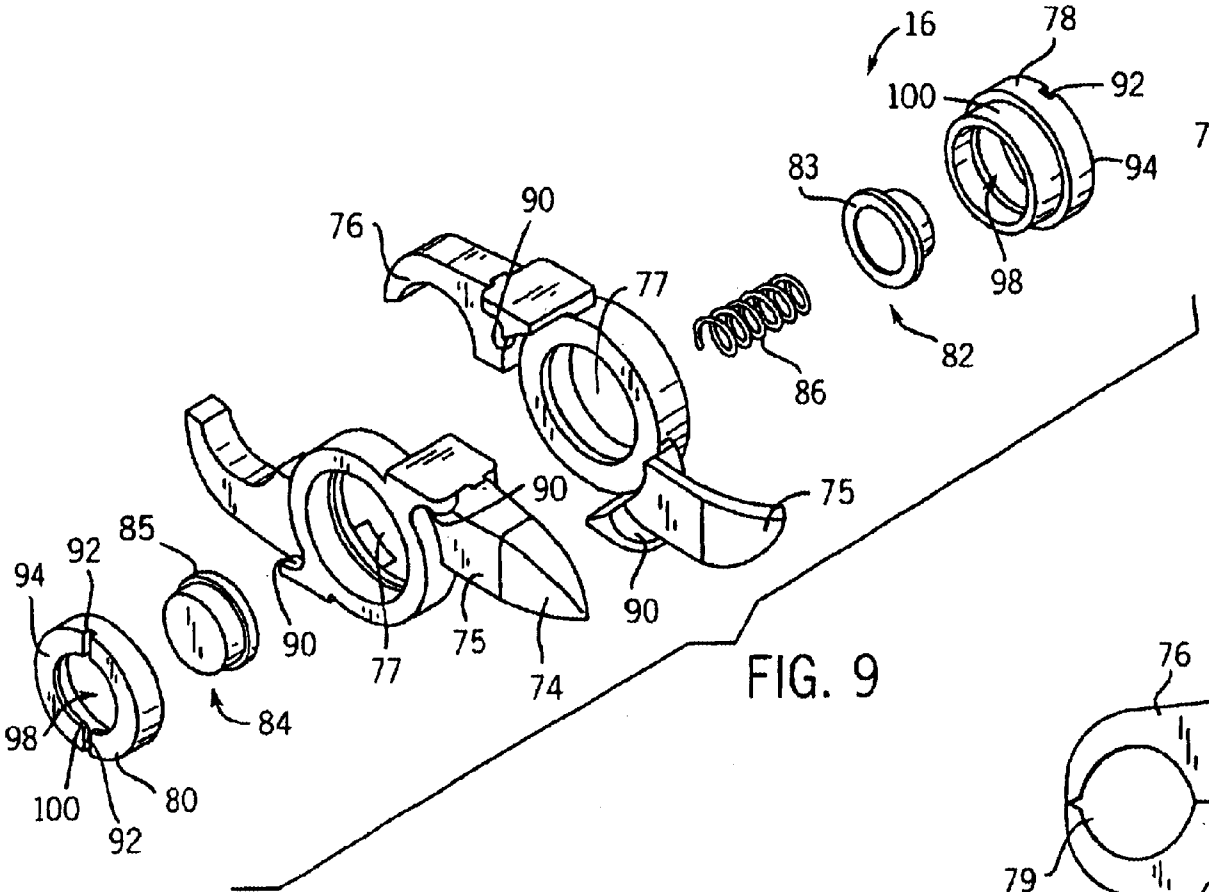
FIG. 9 is an exploded view of the axle assembly and implements of FIGS. 7 and 8.
Figure 13:
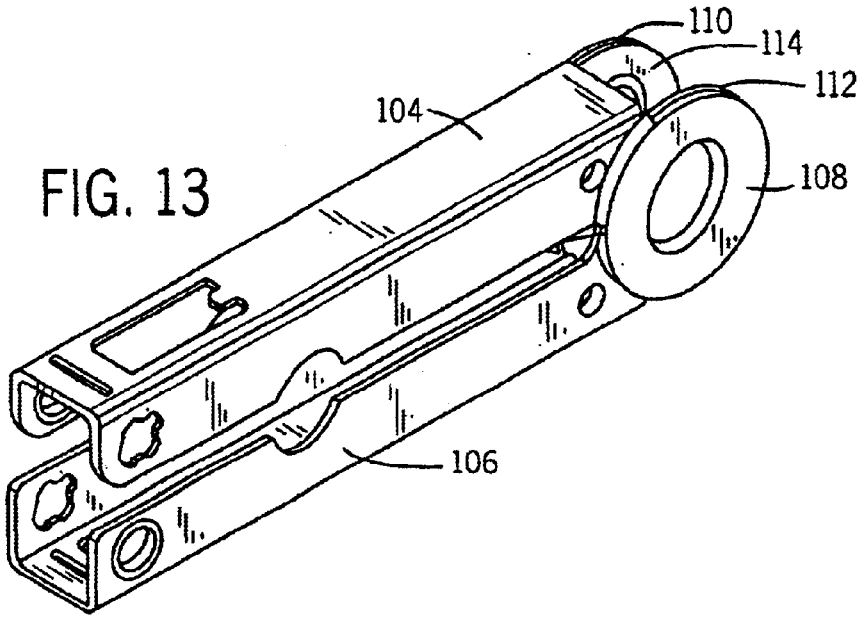
FIG. 13 is an isometric view of a pair of noninterchangeable handles of an alternate embodiment of the present invention.
Figure 14:
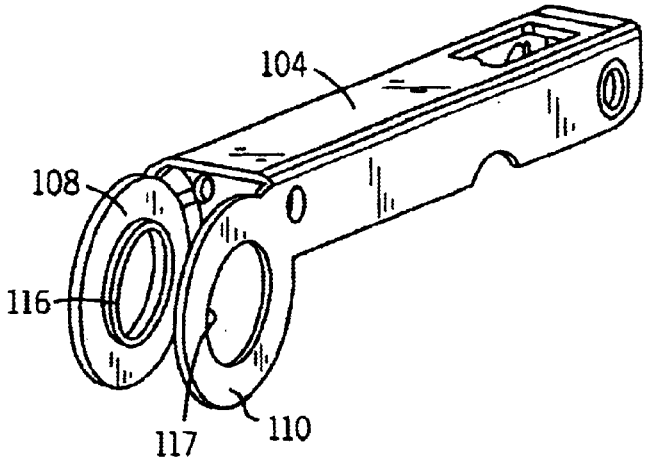
FIG. 14 is an isometric view of one of the noninterchangeable handles of FIG. 13.
Figure 15:
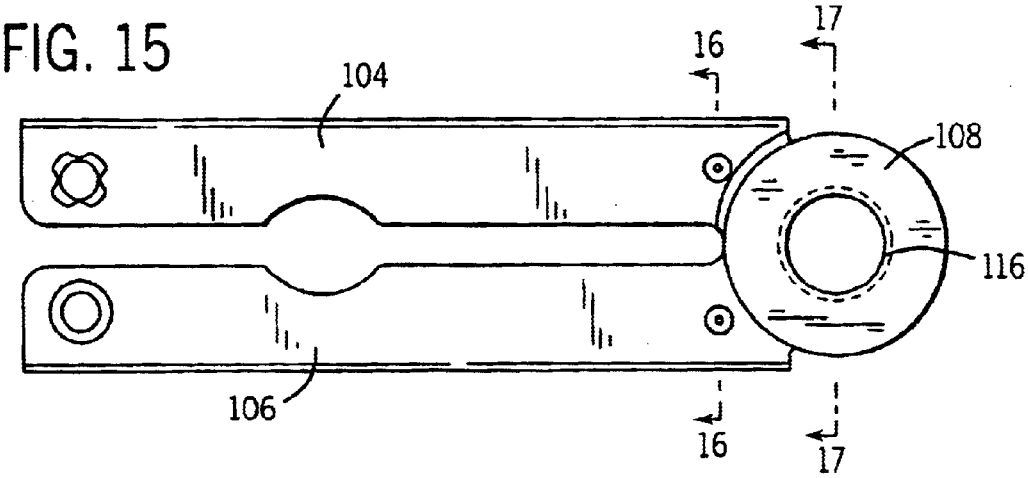
FIG. 15 is a side view of the pair of noninterchangeable handles of FIG. 13.
Figure 16:
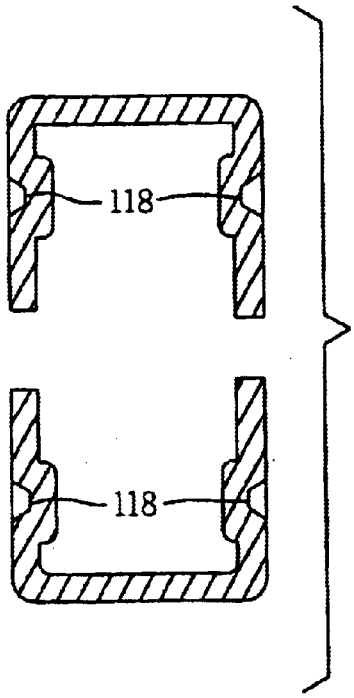
FIG. 16 is a cross-sectional view taken generally along line 16—16 of FIG. 15.
Figure 17:
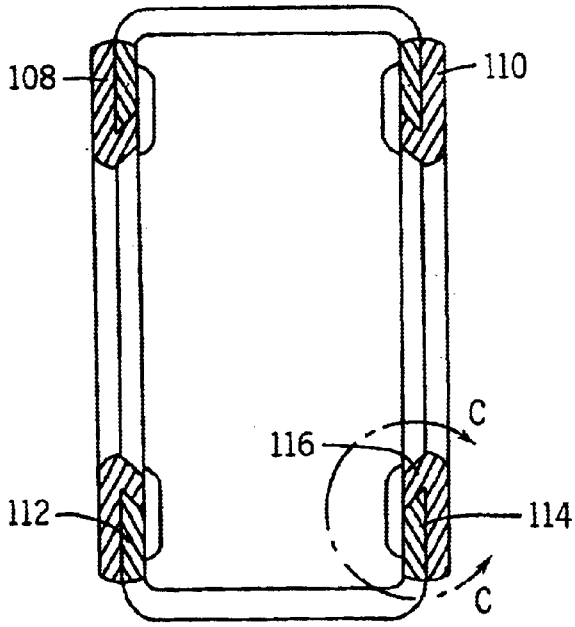
FIG. 17 is a cross-sectional view taken generally along line 17—17 of FIG. 15.
Figure 18:
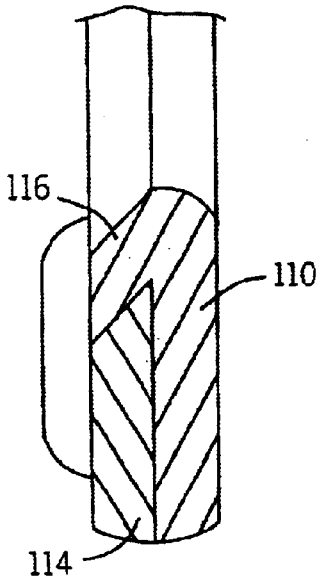
FIG. 18 is an enlarged view of detail C of FIG. 17.
Figures 19, 20:
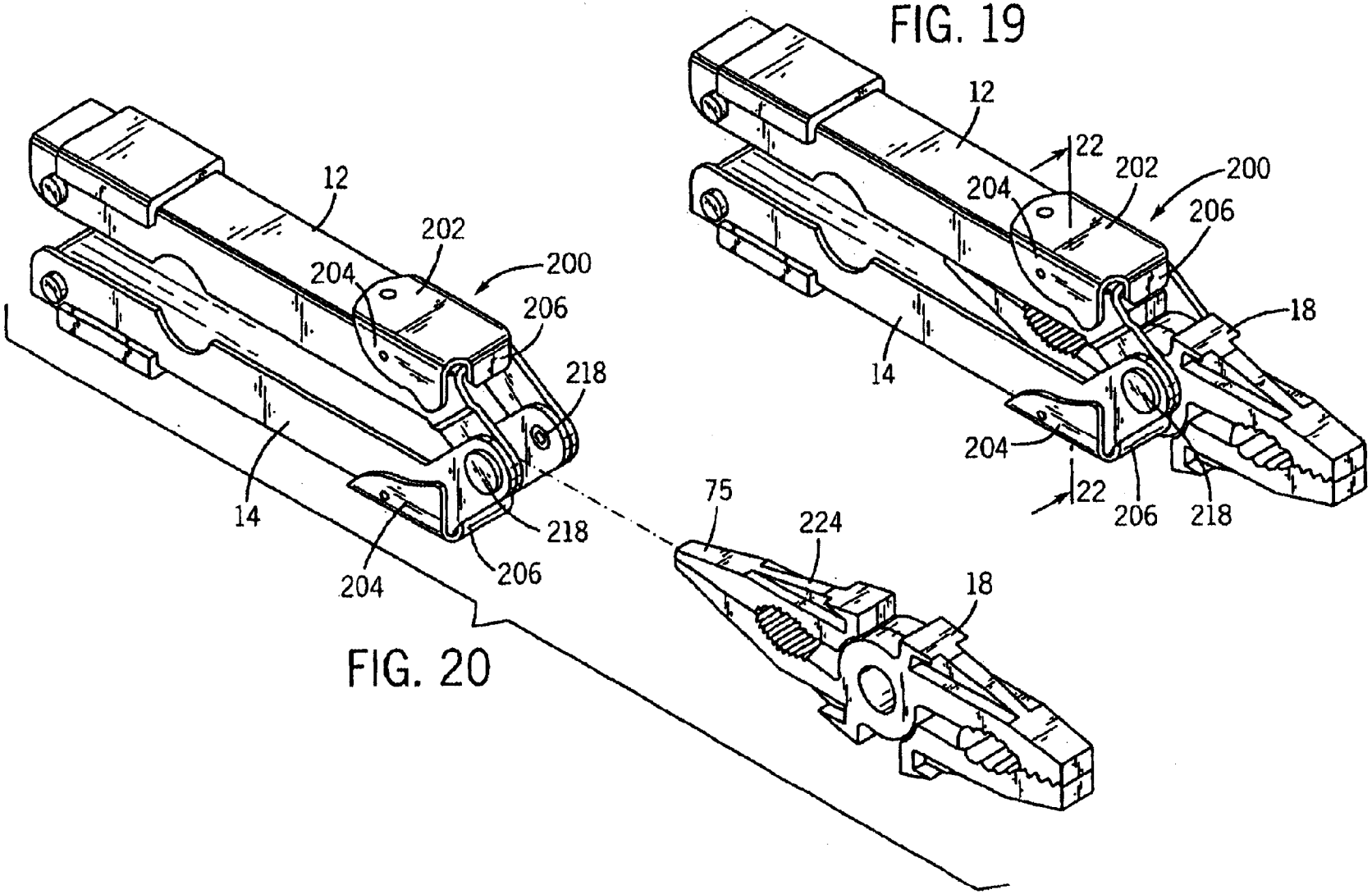
FIG. 19 is a perspective view of an exemplary embodiment of the multi-function tool.
FIG. 20 is an exploded perspective view of the multi-function tool depicted in FIG. 19.

Referring to FIGS. 7–9, axle assembly 16 permits implement 18 to be easily interchanged with other implement assemblies. In the preferred embodiment, a working portion 74 of implement 18 is positioned opposite distal end 52 of handles 12 and 14. Working portion 74 may be a wire cutter having a set of interlocking jaws 75. A tang portion 76 is located opposite working portion 74 and received in channel 33 of handles 12 and 14. In the preferred embodiment, tang portion 76 is also a working implement such as a nipper 79.

As illustrated in FIGS. 9 and 11, axle assembly 16 extends transversely through openings 47 formed in plates 38, 40, 42 and 44, and a central opening 77 formed in implement 18 between working portion 74 and tang portion 76. Axle assembly 16 includes a first end member 78, a second end member 80, a first button 82, a second button 84, and a spring 86. First end member 78 and second end member 80 include an inwardly extending flange 102, 103 respectively. Each button 82, 84 includes an outwardly extending flange 83, 85 respectively. Spring 86 is disposed between each button 82 and 84 to bias buttons 82 and 84 into engagement with end members 78 and 80, such that flanges 83, 85 of buttons 82, 84 are in contact with flanges 102, 103 of end members 78, 80 respectively (See FIG. 11). A detent 90 formed between central opening 77 and tang portion 76 engages inwardly extending posts 34. Implement 18 is restricted from movement relative to the handles by the abutment of detent 90 with posts 34.

A service tool can be inserted in a groove 92 formed in a top surface 94 of first and second end members 78 and 80 to unlock axle assembly 16. Buttons 82 and 84 are inserted through a button opening 98 formed in the center of end members 78 and 80. A cylindrical portion 100 of first member 78 threadingly engages cylindrical portion 100 of second member 80. In the alternative, member 78 can be press fit with member 80. FIGS. 10, 11 and 12 further illustrate the preferred embodiment of the present invention having removable jaws 75 and interchangeable handles 12 and 14.

Referring to FIGS. 19–27, an alternative embodiment of the present invention is shown. In the alternative embodiment, a latch mechanism, shown as a latch lever 200 is used to secure the implement 18 to the handles 12 and 14 rather than the axle assembly 16 (see FIG. 9). The handles 12, 14 are pivotally coupled together by pivotal connections shown as rivets 218. The latch lever 200 includes a latch plate 202 extending along the exterior surface of the handles 12, 14. Extending orthogonally from the latch plate 202 are a pair of latch wings 204. An engagement mechanism, shown as latch finger 206, extends from a forward end of the latch lever 200.

Figure 21:
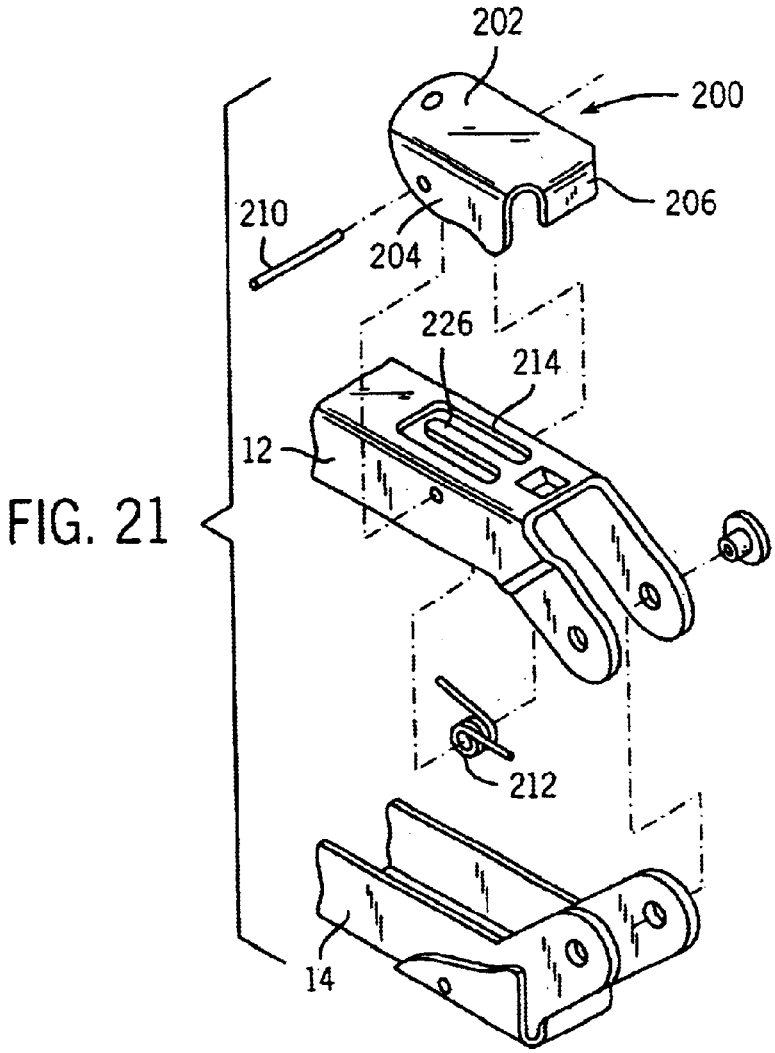
FIG. 21 is an exploded view of the assembly of the latch lever of the present invention.
Figure 26:
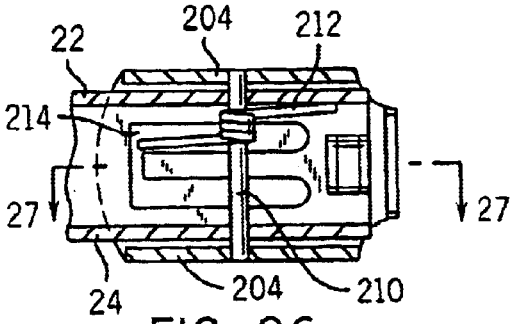
FIG. 26 is a cross-sectional view taken generally along line 26—26 of FIG. 25.

Referring to FIGS. 21 and 26, the latch lever 200 is attached to the handle 12, 14 by a pivot, shown as a pivot bar 210, that extends between the first and second side walls 22, 24. The latch wings 204 are pivotally coupled to the pivot bar 210 on the exterior sides of the first and second side walls 22, 24. Alternatively, the latch lever 200 can be coupled to the implement 18 using a similar pivot arrangement.

Referring to FIGS. 21–23 and 26, a bias mechanism, shown as latch spring 212 is disposed on the pivot bar 210 and biases the latch lever 200 into an engaged position. The latch spring 212 is a torsion spring, one arm of which engages the handle 12, 14, and the other arm of which extends through a latch spring slot 214 in the handle 12, 14 to engage the bottom of the latch plate 202.

Figure 27:
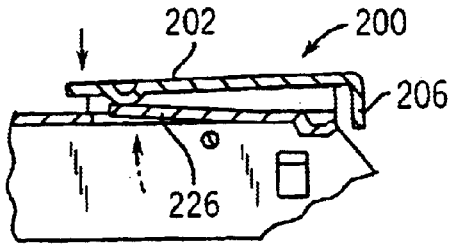
FIG. 27 is a cross-sectional view taken generally along line 27—27 of FIG. 26 showing in alternative embodiment of the latch lever.

Referring to FIG. 27, in an alternative embodiment, the latch spring slot 214 can have an integral spring 226 that biases the latch lever 200 into the engaged position.

Figure 22:
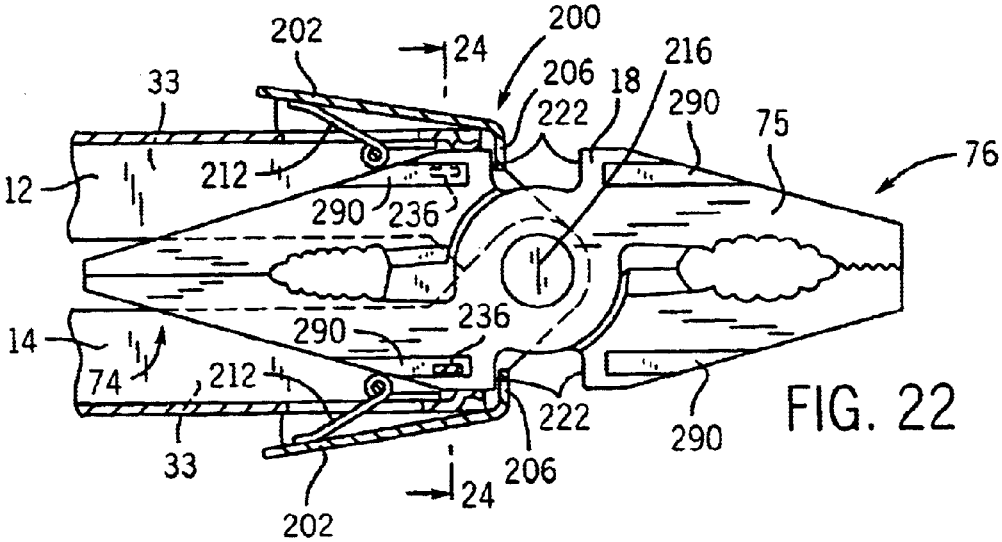
FIG. 22 is a cross-sectional view taken generally along line 22—22 of FIG. 19.
Figure 23:
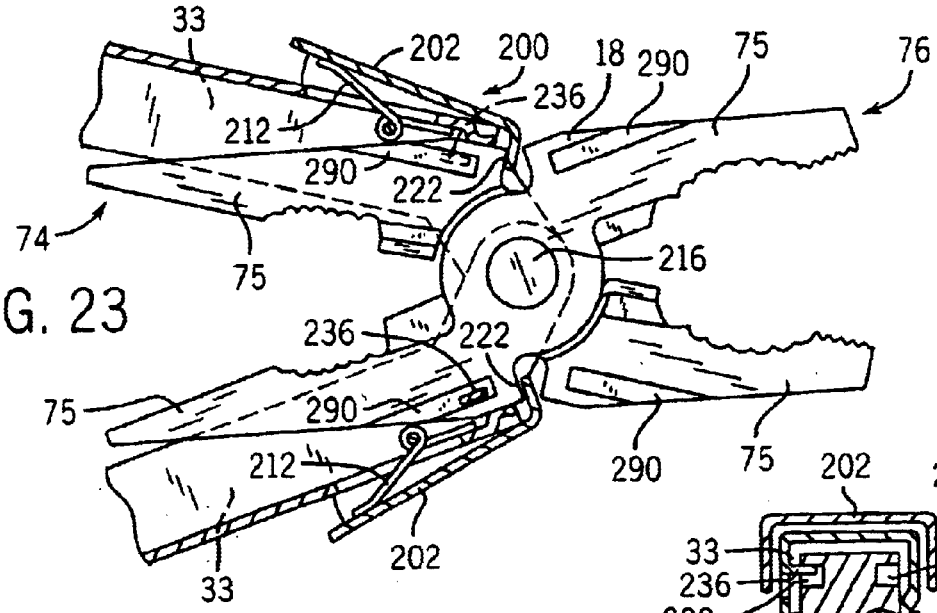
FIG. 23 is the view of FIG. 22 with the multi-function tool jaws in an opened position.
Figure 24:
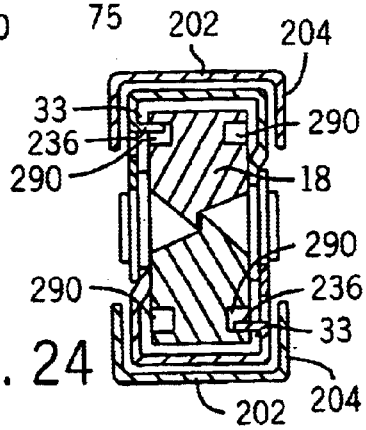
FIG. 24 is a cross-sectional view taken generally along line 24—24 of FIG. 22.

Referring to FIGS. 22–24, extending into the channel 33 is a catch, shown as a post 236, that engages the implement 18. Implement 18 includes an axle 216 that pivotally couples jaws 75. Each jaw 75 includes a ledge 222 configured to engage the latch finger 206. Further, detents 290 are configured to receive the post 236 when the implement 18 is coupled to the handles 12, 14.

Figure 28:
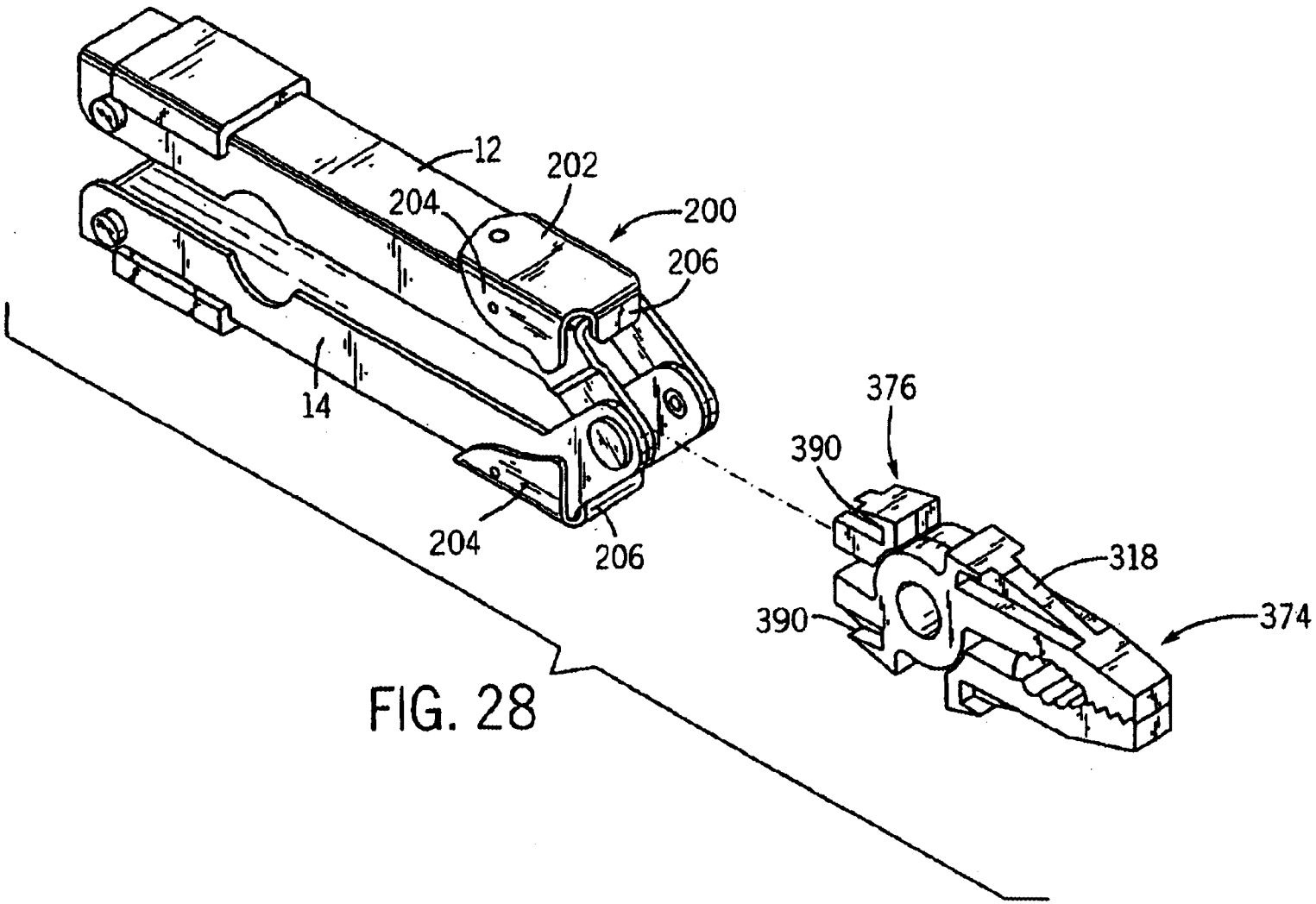
FIG. 28 is an exploded perspective view of a multi-function tool according to an exemplary embodiment.

Referring to FIG. 28, in an alternative embodiment, an implement 318 has a working portion 374 and an engagement portion 376. Accordingly, the implement 318 is removable, but not reversible. The engagement portion 376 has detents 390 configured to receive the posts 236. The handles 12, 14 and lever latches 200 function in an equivalent manner to that described above and depicted in FIGS. 19–27.

Figure 29:
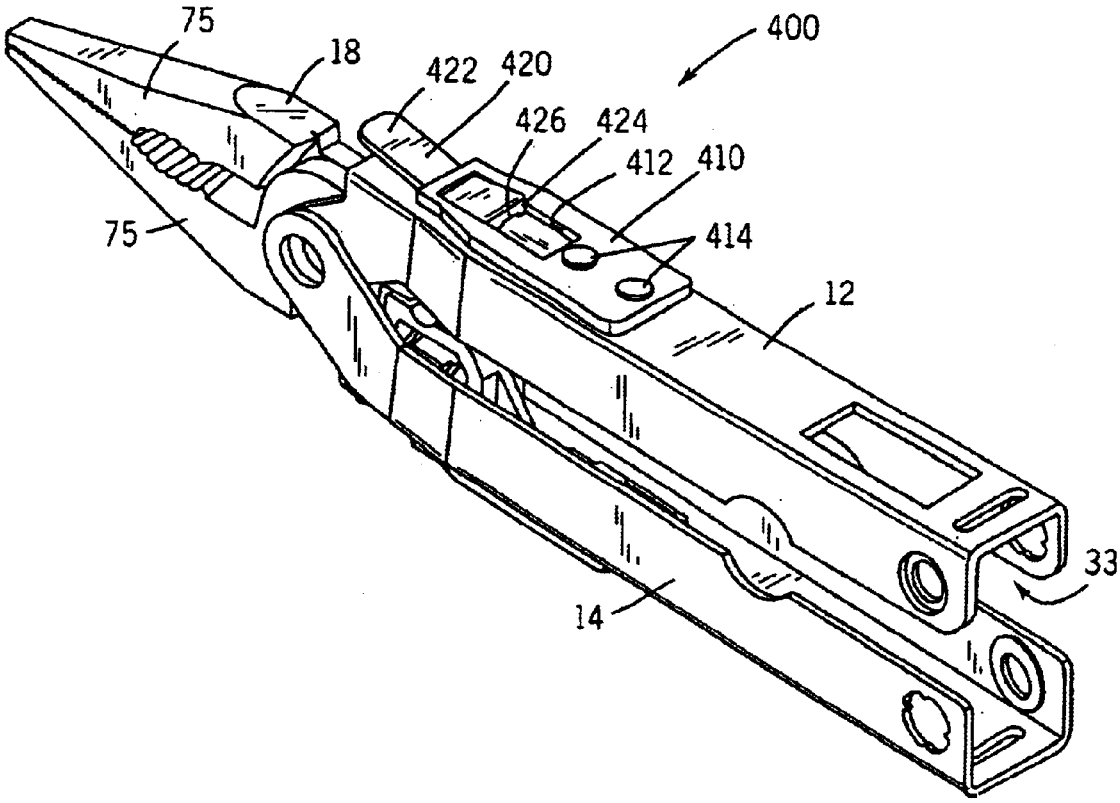
FIG. 29 is a perspective view of a multi-function tool according to an exemplary embodiment.

FIGS. 29–32 depict an alternative embodiment of the implement latch mechanism. FIG. 29 depicts latch mechanism 400, which includes a cap 410 secured to handles 12, 14. Cap 410 includes an opening 412 and is attached to handles 12, 14 via a suitable attachment mechanism, shown as rivets 414.

Referring further to FIG. 29, a latch, shown as, but not limited to, rocker 420 includes a latch key 422 on one end and a locking tab 424 extending from the other end, the locking tab 424 having an aperture 426. Locking tab 424 extends through a corresponding aperture (not shown) in handle 12 into channel 33.

Figure 30:
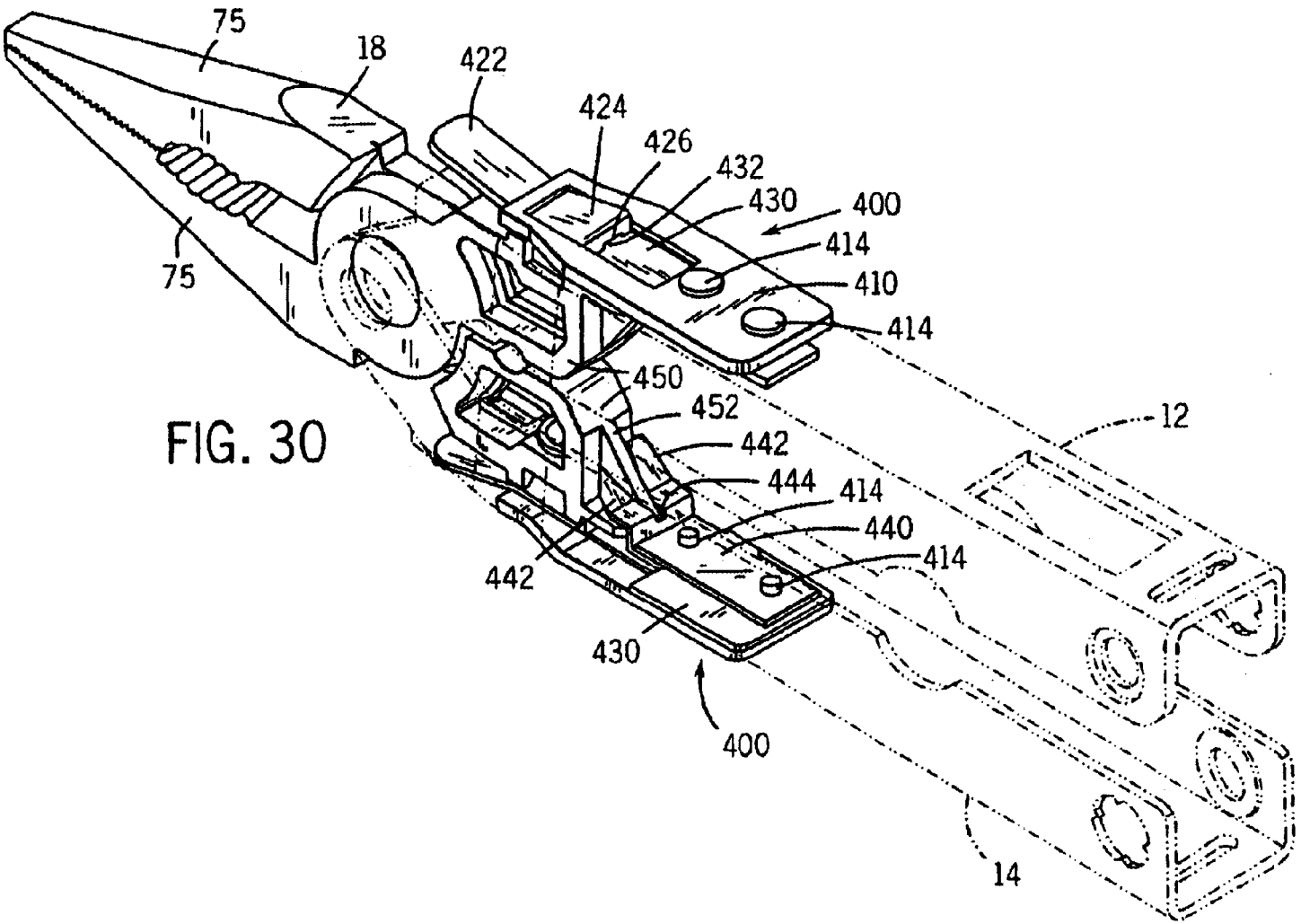
FIG. 30 is the view of FIG. 29 with the handles drawn in phantom lines to show the details of a latch mechanism.
Figure 31:
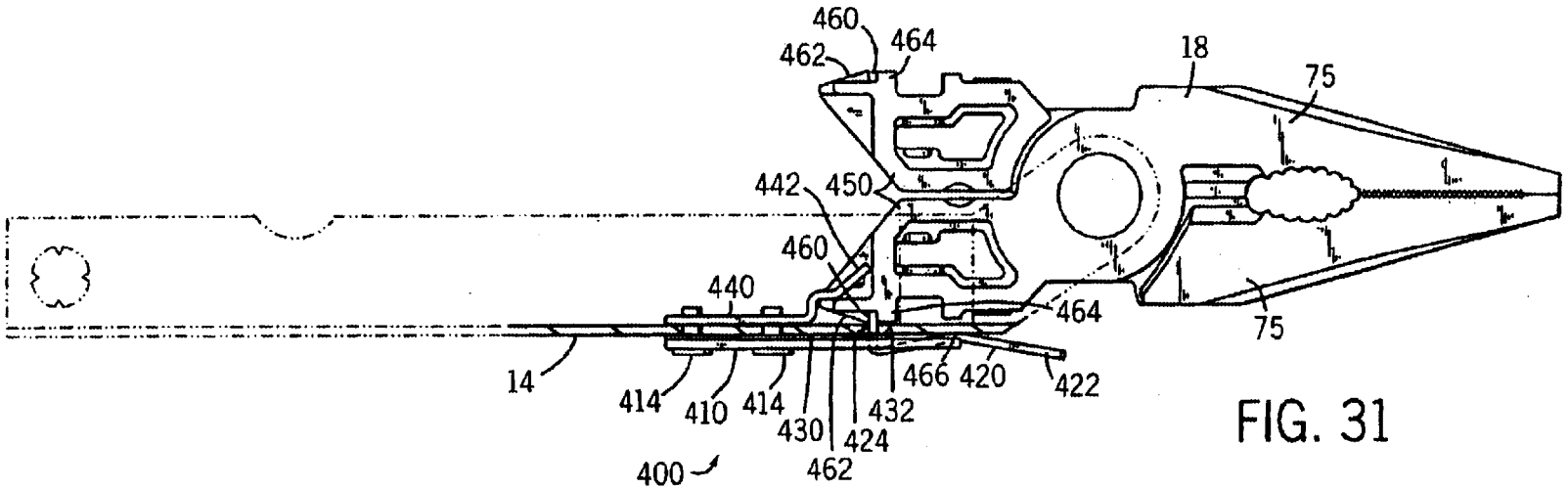
FIG. 31 is a side view of an implement of a multi-function tool with one jaw tang engaged with a latch mechanism, shown with the associated handle drawn in phantom lines.
Figure 32:
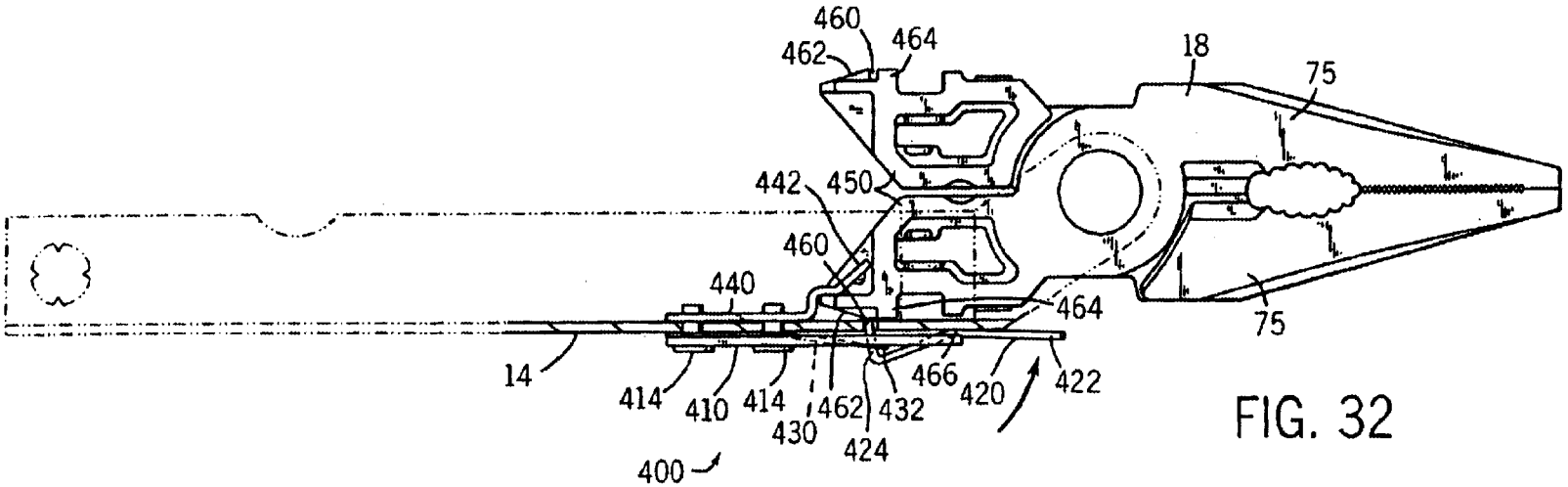
FIG. 32 is a side view of an implement of a multi-function tool with one jaw tang disengaged with a latch mechanism, shown with the associated handle drawn in phantom lines.

Referring to FIGS. 30–32, spring, shown as, but not limited to, spring plate 430 is secured to handles 12, 14 under cap 410 by rivets 414. The handles 12, 14 are shown primarily in phantom in FIGS. 30–32 to show the inner details of the latch mechanism 400. The area of handle 14 within latch mechanism 400 is shown in solid lines in FIGS. 31 and 32 to show how rocker 420 and handle 14 operate together. Latch mechanism 400 is shown on one of tangs 450 in FIGS. 31 and 32, but may be present on both tangs 450 as shown in FIG. 30. An extension finger 432 extends from spring plate 430 into aperture 426 of locking tab 424.

A guide mechanism, shown as slide 440 is attached within channel 33 of handles 12, 14. Rivets 414 may be used to secure slide 440. A pair of prongs 442 extend from the slide 440 to secure a pair of jaw tangs 450. A rib 452 extends into a slot 444 disposed between the prongs 442 of each slide 440.

FIGS. 13–18 illustrate an alternative embodiment of the present invention wherein multi-function tool 10 includes a first unremovable handle 104 and a second unremovable handle 106. First handle 104 includes a first plate 108 and a second plate 110 extending therefrom, and second handle 106 includes a first plate 112 and a second plate 114 extending therefrom. A shoulder 116 engages a beveled edge formed in an opening 117 in second plate 114 wherein the edges of shoulder 116 are permanently crimped over beveled edges along opening 117 to secure plates 108, 110, 112 and 114 together. Handles 104 and 106 further include a plurality of inwardly projecting posts 118 configured to engage detent 90 formed in interchangeable implement 18.

The operation of reversing and/or interchangeable implement 18 and interchanging handles 12 and 14 will now be explained in reference to FIGS. 10 and 6. As shown in FIG. 10, working portion 74 is in the extended working position. A user can remove implement 18 to employ working portion 76 by depressing buttons 82 and 84 towards one another until the top surface of buttons 82 and 84 no longer engage any of plates 38, 40, 42 and 44. Implement 18 is then simply pulled straight out away from handles 12 and 14. To employ working portion 76, implement 18 is simply flipped over and working portion 74 is inserted into channel 33. Buttons 82 and 84 are depressed until engagement with plates 38, 40, 42 and 44 is achieved. As implement 18 is inserted into channel 33 detents 290 engage posts 34 so that the handles operate to pivot the working implement 76 about axle assembly 16.

In the exemplary embodiment of FIGS. 19–27, the implement 18 can be removed from the handles 12, 14 by depressing the latch plates 202 such that the latch fingers 206 disengage from the ledges 222. Once the latch fingers 206 have been disengaged, the implement 18 may be removed from the handles 12, 14.

Figure 25:
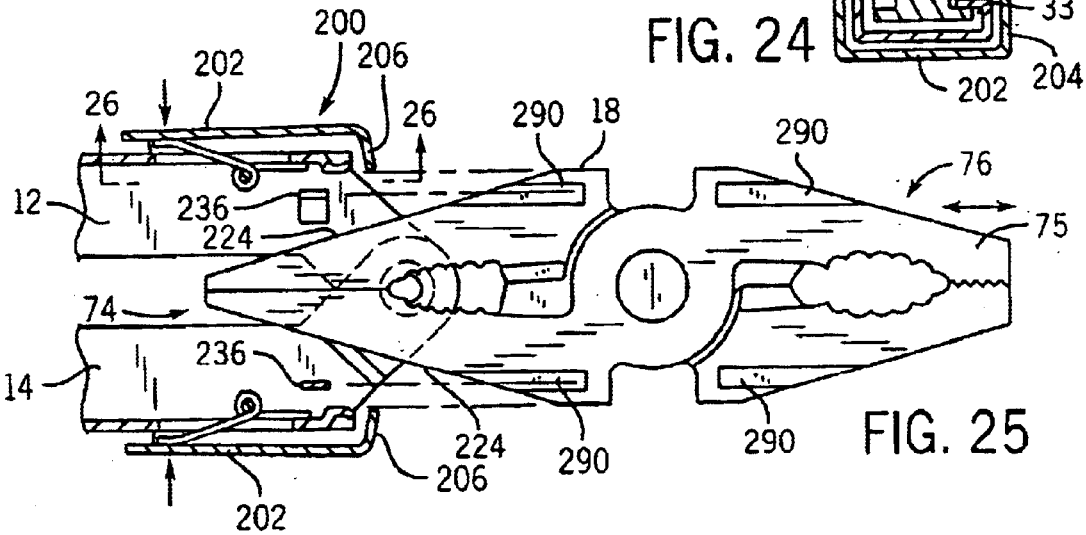
FIG. 25 is a cross-sectional view taken generally along line 22—22 of FIG. 19, but depicting the removal or insertion of the implement of the multi-function tool.

Referring to FIGS. 22, 23 and 25, to engage the implement 18, one of the working portions 74, 76 is inserted into handles 12, 14 until the latch fingers 206 snap into position on the ledges 222. The exterior surfaces 224 of jaws 75 (see FIG. 20) function as ramps to automatically pivot the latch levers 200 away from the engaged position as the implement 18 is inserted into the handles 12, 14. Because the latch levers 200 are biased in the engaged position by the latch springs 212, the user need only slide the implement into the handles 12, 14, and the latch levers 200 will automatically engage and lock the implement 18 into working position.

Referring to FIG. 25, as the implement 18 slides into position, the posts 236 simultaneously slide into detents 290, engaging the jaws 75. The engagement of the posts 236 with the detents 290 interlocks the handles 12, 14 with the jaws 75. Referring to FIGS. 22 and 23, the engagement of the posts 36 with the detents 290 permits the handles 12, 14 to open the jaws 75 as the handles 12, 14 are opened, and provides the user with positive control over jaw positioning. The embodiment depicted in FIG. 28 functions in a similar manner.

In the exemplary embodiment of FIGS. 29–32, the implement 18 may be removed from the handles 12, 14 by depressing the latch keys 422 to disengage locking tabs 424 from the tangs 450. Referring to FIG. 31, implement 18 is secured to the handle 14 by the interlocking of the locking tab 424 and a locking slot 460. The locking slot 460 is disposed between a ramped post 462 and a protrusion 464. Each tang 450 has a similar locking structure. Referring to FIG. 32, when latch key 422 is depressed, the rocker 420 pivots about a pivot point 466 that engages handle 14 lifting locking tab 424 out of locking slot 460, permitting implement 18 to be removed from handles 12, 14. When latch key 422 is not depressed, spring plate 430, via extension finger 432, biases locking tab 424 into locking slot 460 as shown in FIG. 31.

Further referring to FIG. 31, ramped post 462 permits the implement 18 to be inserted into handle 14 and automatically snap-lock into place. As implement 18 slides into an operative position, locking tab 424 engages ramped post 462 and is deflected against the force of the spring plate 430 until locking tab 424 drops into locking slot 460, locking implement into a use position.

The engagement of prongs 442 with tangs 450 permits the handles 12, 14 to open the jaws 75 as the handles 12, 14 are opened, providing the user with positive control over jaw 75 positioning, as discussed with respect to the other exemplary latch embodiments.

Figure 6:
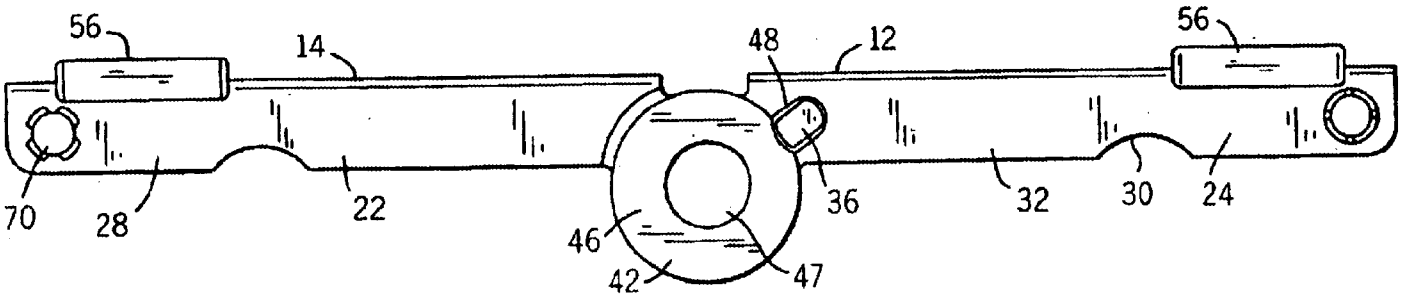
FIG. 6 is a partial side view of the interchangeable handles of the present invention with one handle at a 180° angle to the other handle.

In an exemplary embodiment shown in FIG. 6, either handle 12 or 14 can be interchanged with a different handle by initially positioning handle 12 with respect to handle 14 so that notch 48 aligns with post 36. Once notch 48 is in alignment with post 36, either handle 12 or 14 can be removed by pulling one of the handles in a direction away from the other handle. A new handle can be inserted by aligning the notch and post of the new handle with the notch and the post of the existing handle. After the notches and posts of the new handle are aligned with the notches and posts of the existing handle, locking engagement of plates 38, 40, 42 and 44 is achieved by rotating one or both of the handles away from the positions of alignment between notch 48 and post 36.

Although the invention has been described in conjunction with specific embodiments thereof, it is evident that many alternatives, modifications and variations will be apparent to those skilled in the art. Accordingly, the invention as described and hereinafter claimed is intended to embrace all such alternatives, modifications and variations that fall within the spirit and broad scope of the appended claims.

What is claimed is:

1. A latch mechanism coupled to a multi-function tool having at least one handle and an implement including at least one tang, the latch mechanism comprising:

a spring plate secured to the handle;

a rocker having a locking tab operatively coupled to the spring plate; and a cap coupled to the outside of the handle and cooperating with the spring plate and the rocker;

a guide mechanism coupled to the handle and comprising a pair of prongs configured to receive a rib extending from the at least one tang; and wherein the latch mechanism and the guide mechanism are configured to cooperate to removably secure the implement to the handle.

2. The latch mechanism of claim 1, wherein the locking tab engages a locking slot disposed in the implement.

3. The latch mechanism of claim 2, wherein the spring plate biases the locking tab into the locking slot.

4. The latch mechanism of claim 1, further comprising a latch key coupled to the rocker, wherein the implement is released by depressing the latch key.

5. The latch mechanism of claim 1, further comprising a plurality of ancillary tools pivotally coupled to at least one of the handles.

6. The latch mechanism of claim 1, wherein the guide mechanism is configured to align the at least one tang of the implement as the implement engages the at least one handle.

7. The latch mechanism of claim 1, wherein the guide mechanism is coupled to the handle with at least one fastener.

8. A multi-function tool, comprising:

a pair of handles;

a latch mechanism secured to at least one of the handles, the latch mechanism including a locking tab and a spring plate;

an implement removably secured to the at least one of the handles by the latch mechanism, the implement comprising a pair of interlocking jaws, each jaw having a working portion and a tang; and a guide mechanism coupled to at least one of the handles, the guide mechanism comprising a pair of prongs configured to receive a portion of one of the tangs and to secure the tang to one of the handles.

9. The multi-function tool of claim 8, wherein the guide mechanism is configured to align one of the tangs of the implement as the implement engages the at least one of the handles.

10. The multi-function tool of claim 8, wherein the guide mechanism is coupled to the at least one of the handles with at least one fastener.

11. The multi-function tool of claim 8, wherein the spring plate biases the locking tab into a locking slot disposed in the implement.

12. The multi-function tool of claim 11, wherein the latch mechanism further includes a latch key operatively coupled to the locking tab.

13. The multi-function tool of claim 12, wherein the implement is released by depressing the latch key.

14. The multi-function tool of claim 8, further comprising a plurality of ancillary tools pivotally coupled to at least one of the handles.

15. The multi-function tool of claim 8, wherein the implement is removed by depressing the latch mechanism.

16. A multi-function tool, comprising:

a pair of handles;

a latch mechanism secured to at least one of the handles, the latch mechanism including a locking tab and a spring plate;

an implement including a pair of interlocking jaws, each jaw having a working portion and a tang, the implement being releasably secured to the at least one of the handles by the latch mechanism;

a guide mechanism coupled to at least one of the handles, the guide mechanism including a pair of prongs configured to receive a rib extending from one of the tangs, the guide mechanism securing the one of the tangs to one of the handles; and wherein the implement is removed by depressing the latch mechanism.

17. The multi-function tool of claim 16, further comprising a latch key operatively coupled to the locking tab, wherein the implement is released by depressing the latch key.

18. The multi-function tool of claim 16, further comprising a plurality of ancillary tools pivotally coupled to at least one of the handles.

19. The multi-function tool of claim 16, wherein the guide mechanism is configured to align the one of the tangs of the implement as the implement engages the at least one of the handles.

20. The multi-function tool of claim 16, wherein the guide mechanism is coupled to the at least one handle of the handles with at least one fastener.

* * * * *

UNITED STATES PATENT AND TRADEMARK OFFICE

CERTIFICATE OF CORRECTION

PATENT NO. : 6,721,983 B2 
DATED : April 20, 2004
INVENTOR(S) : Edgar A. Dallas and Phillip A. Montague It is certified that error appears in the above-identified patent and that said Letters Patent is hereby corrected as shown below:

Column 10,
Line 9, delete "handle".

Signed and Sealed this

Twenty-fourth Day of August, 2004

JON W. DUDAS
*Director of the United States Patent and Trademark Office*